US010094518B2

(12) United States Patent
Ma et al.

(10) Patent No.: US 10,094,518 B2
(45) Date of Patent: Oct. 9, 2018

(54) LED HIGH BAY LIGHT

(71) Applicant: MESTER LED LIMITED

(72) Inventors: Erhua Ma, Guangdong (CN); Ping Li, Hunan (CN); Chunjiang Shuai, Guangdong (CN)

(73) Assignee: MESTER LED LIMITED, Shenzhen (CN)

( * ) Notice: Subject to any disclaimer, the term of this patent is extended or adjusted under 35 U.S.C. 154(b) by 101 days.

(21) Appl. No.: 15/247,847

(22) Filed: Aug. 25, 2016

(65) Prior Publication Data

US 2017/0370532 A1 Dec. 28, 2017

(30) Foreign Application Priority Data

Jun. 28, 2016 (CN) ..... 2016 2 0660333 U

(51) Int. Cl.

| | |
|---|---|
| ***F21S 4/00*** | (2016.01) |
| ***F21K 9/27*** | (2016.01) |
| ***F21V 5/00*** | (2018.01) |
| ***F21V 23/02*** | (2006.01) |
| *F21Y 103/10* | (2016.01) |
| *F21Y 115/10* | (2016.01) |

(52) U.S. Cl.

CPC ..... *F21K 9/27* (2016.08); *F21V 5/007* (2013.01); *F21V 23/02* (2013.01); *F21Y 2103/10* (2016.08); *F21Y 2115/10* (2016.08)

(58) Field of Classification Search

CPC ..... F21K 9/27; F21V 5/007; F21V 23/02
USPC ..... 362/222
See application file for complete search history.

(56) References Cited

U.S. PATENT DOCUMENTS

| | | | | |
|---|---|---|---|---|
| 9,016,892 | B1 * | 4/2015 | Scribante | F21V 17/002 362/222 |
| 2015/0219320 | A1 * | 8/2015 | Durdle | F21S 8/086 362/240 |

* cited by examiner

*Primary Examiner* — Anh Mai
*Assistant Examiner* — Meghan Ulanday

(57) ABSTRACT

An LED high bay light comprises a plurality of LED illuminant engines arranged abreast and alternately; each of the LED illuminant engine comprises an LED strip-shaped illuminant and an optical lens set covering the LED strip-shaped illuminant; the optical lens set comprises a plurality of strip-shaped optical lenses arranged conterminously; and two adjacent strip-shaped optical lenses are connected to each other through a mutual cooperation of the stepped spigots arranged oppositely. Each illuminant engine thereof adopts a structure of strip-shaped optical lens set with multiple sections, greatly reducing the difficulty in making molds and the cost for manufacturing parts.

5 Claims, 4 Drawing Sheets

LED HIGH BAY LIGHT

CROSS-REFERENCE TO RELATED APPLICATIONS

The present application claims the benefit of Chinese Patent Application No. 201620660333.1 filed on Jun. 28, 2016, the contents of which are hereby incorporated by reference.

TECHNICAL FIELD

The Invention relates to the field of lighting technology and particularly to an LED high bay light.

BACKGROUND

It is well known that, the LED high bay light, of which the illuminant part and the optical lens are both of linear structure, is a kind of new high-power lighting fixture with a maximum length of 1100 mm emerged in the market of North America recently. However, the existing optical lens is of the structure of one-piece injection molding; thus the difficulty in and the expenses for making the mold and the cost for manufacturing the parts will be greatly increased as the requirement on the length of the optical lens increases.

SUMMARY OF THE INVENTION

The Invention is to provide an LED high bay light; each illuminant engine thereof adopts a structure of strip-shaped optical lens set with multiple sections, greatly reducing the difficulty in making molds and the cost for manufacturing parts.

The Invention is achieved as follows:

An LED high bay light, wherein, the LED high bay light comprises a plurality of LED illuminant engines arranged abreast and alternately; each of the LED illuminant engines comprises an LED strip-shaped illuminant and an optical lens set covering the LED strip-shaped illuminant; the optical lens set comprises a plurality of strip-shaped optical lenses arranged conterminously; and two adjacent strip-shaped optical lenses are connected to each other through the mutual cooperation of the stepped spigots arranged oppositely.

As an improvement of the above-mentioned LED high bay light, the LED strip-shaped illuminant comprises a plurality of LED lamp beads and an LED strip-shaped driving circuit board that drives the LED lamp beads to operate; the LED lamp beads are distributed on the surface of the LED strip-shaped driving circuit board in a matrix; the optical lens set is closely fitted to the surface of the LED strip-shaped driving circuit board to cover the LED lamp beads; the optical lens set is connected to the corresponding LED strip-shaped driving circuit board in a fastening manner through a screw structure.

As an improvement of the above-mentioned LED high bay light, a convex rib structure is arranged along both sides of the strip-shaped optical lens respectively.

As an improvement of the above-mentioned LED high bay light, the LED high bay light further comprises two side plates arranged oppositely and alternately for fixing lamp body; both sides of each of the LED illuminant engines are movably connected to one of the side plates for fixing lamp body through a mutual cooperation between an arc slot and a screw structure respectively.

As an improvement of the above-mentioned LED high bay light, the LED high bay light further comprises a strip-shaped power box; both sides of the strip-shaped power box are connected to one of the side plates for fixing lamp body respectively in a fastening manner; each of the LED illuminant engines is electrically connected to the strip-shaped power box respectively.

As an improvement of the above-mentioned LED high bay light, the LED high bay light further comprises two emergency power packs; the two emergency power packs are arranged oppositely and alternately on the strip-shaped power box, and the two emergency power packs are electrically connected to the strip-shaped power box.

As an improvement of the above-mentioned LED high bay light, a convex rod for mounting suspending chain is arranged on two opposite sides of each of the emergency power pack respectively.

As an improvement of the above-mentioned LED high bay light, the LED high bay light further comprises a mounting box for suspender; the mounting box for suspender is arranged on the strip-shaped power box, and between the two emergency power packs.

The beneficial effects of the Invention are that: an LED high bay light provided by the Invention, wherein, the optical lens set of each LED illuminant engine formed with a plurality of conterminous strip-shaped optical lens is of a structure of multiple sections; the length of the mold of individual optical lens is shorter than the height of the overall optical lens and the process for manufacturing parts is simpler than that for the overall optical lens, therefore, such structure of multiple sections may not only control the risk in product development, but also greatly reduce the difficulty in making molds and the cost for manufacturing parts. Meanwhile, two adjacent strip-shaped optical lenses are connected to each other through a mutual cooperation of the stepped spigots arranged oppositely, not only preventing position shifting and malposition, improving the reliability of the product and realizing perfect assembly and location of the strip-shaped optical lenses, but also preventing dusts entering the illuminant and causing secondary pollution. In addition, a plurality of LED illuminant engines are arranged abreast and alternately, leaving a space between two LED illuminant engines, allowing heat dispersion through convection to be realized during operation of the LED high bay light and thus improving the heat dispersion greatly.

BRIEF DESCRIPTION OF THE DRAWINGS

In order to illustrate the technical schemes in the embodiments of the Invention or in prior art more clearly, the drawings required in description of the embodiments or prior art will be introduced briefly as follows. Obviously, the drawings described below are just a part of the embodiments of the Invention. A person skilled in the art is able to obtain other drawings according to these drawings without any creative work.

DETAILED DESCRIPTION OF THE PREFERRED EMBODIMENTS

Figure 1:
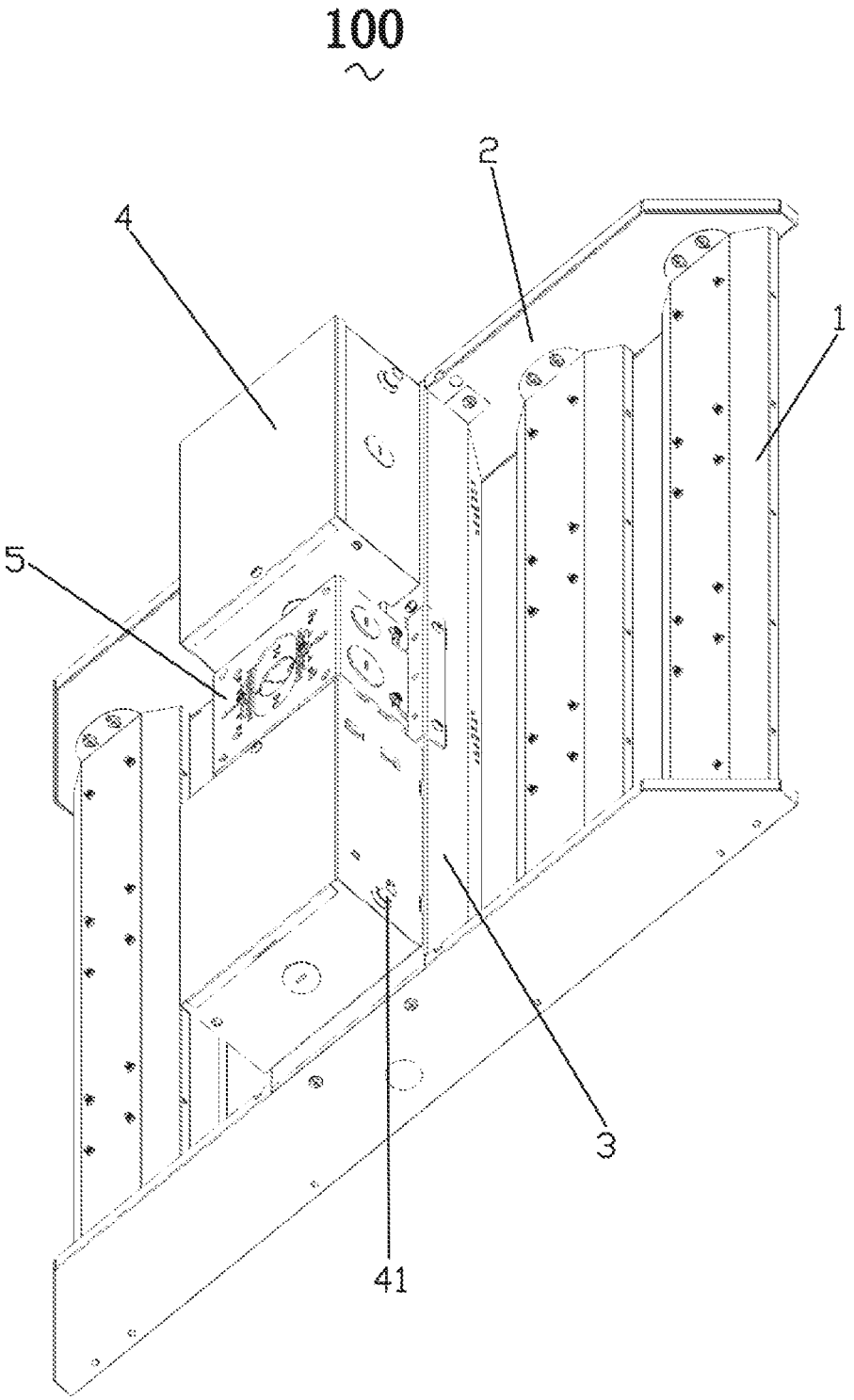
FIG. 1 is an overall structure diagram of a preferred embodiment of the LED high bay light of the Invention.

A clear and full description of the technical schemes of the embodiments of the Invention will be given in combination of the drawings of the embodiments of the Invention as follows. Obviously, the described embodiments are just a part rather than the whole of the embodiments of the Invention. Based on the embodiments of the Invention, any other embodiments obtained by a person skilled in the art without any creative work will fall within the protection scope of the Invention.

As shown in FIGS. 1-4, the embodiment provides an LED high bay light 100; the LED high bay light 100 includes a plurality of LED illuminant engines 1 arranged abreast and alternately; each of the LED illuminant engines 1 includes an LED strip-shaped illuminant 11 and an optical lens set 12 covering the LED strip-shaped illuminant 11; the optical lens set 12 includes a plurality of strip-shaped optical lenses 121 arranged conterminously; and two adjacent strip-shaped optical lenses 121 are connected to each other through a mutual cooperation of the stepped spigots arranged oppositely.

Figure 2:
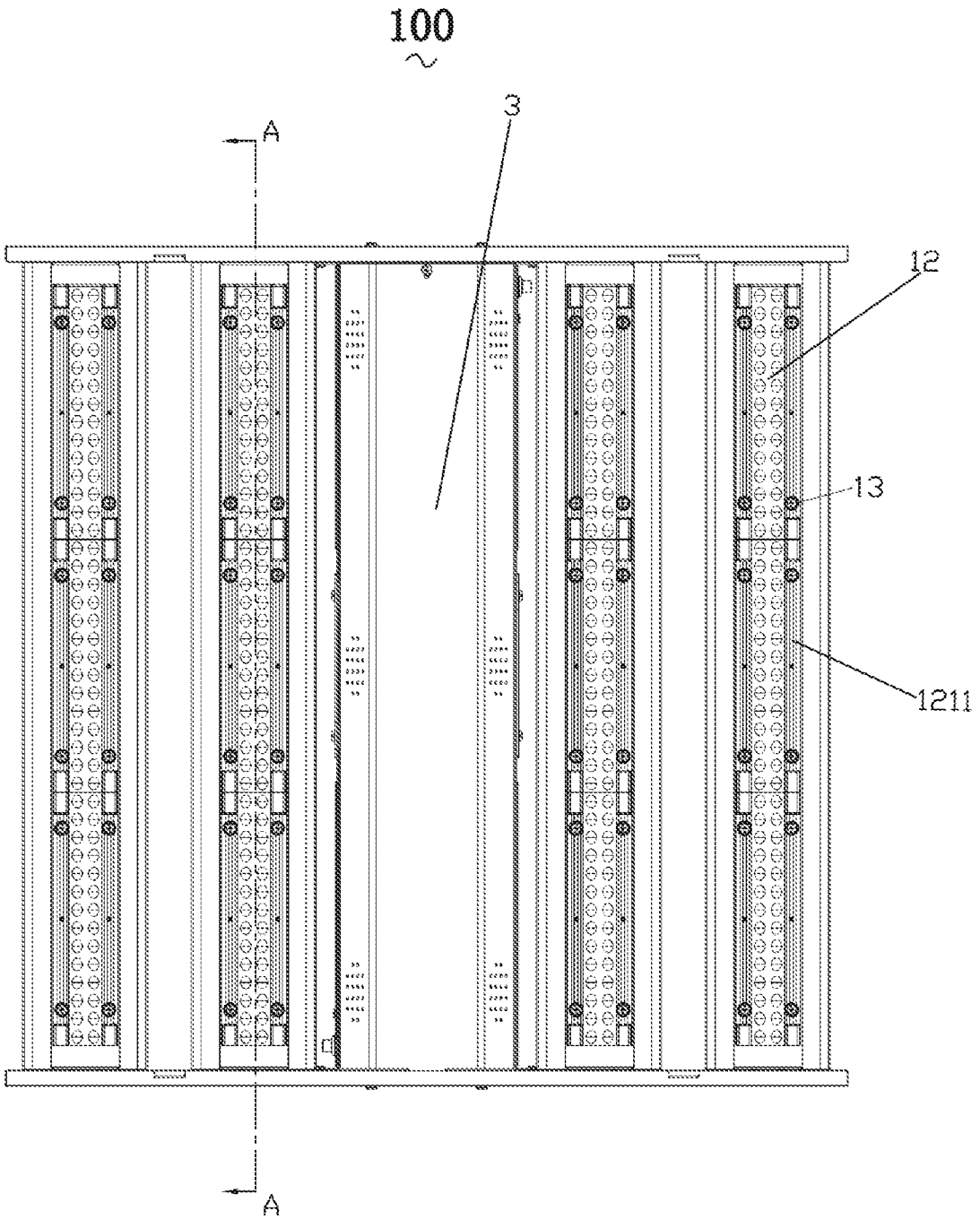
FIG. 2 is a diagram of the front structure of the LED high bay light shown in FIG. 1.
Figure 3:
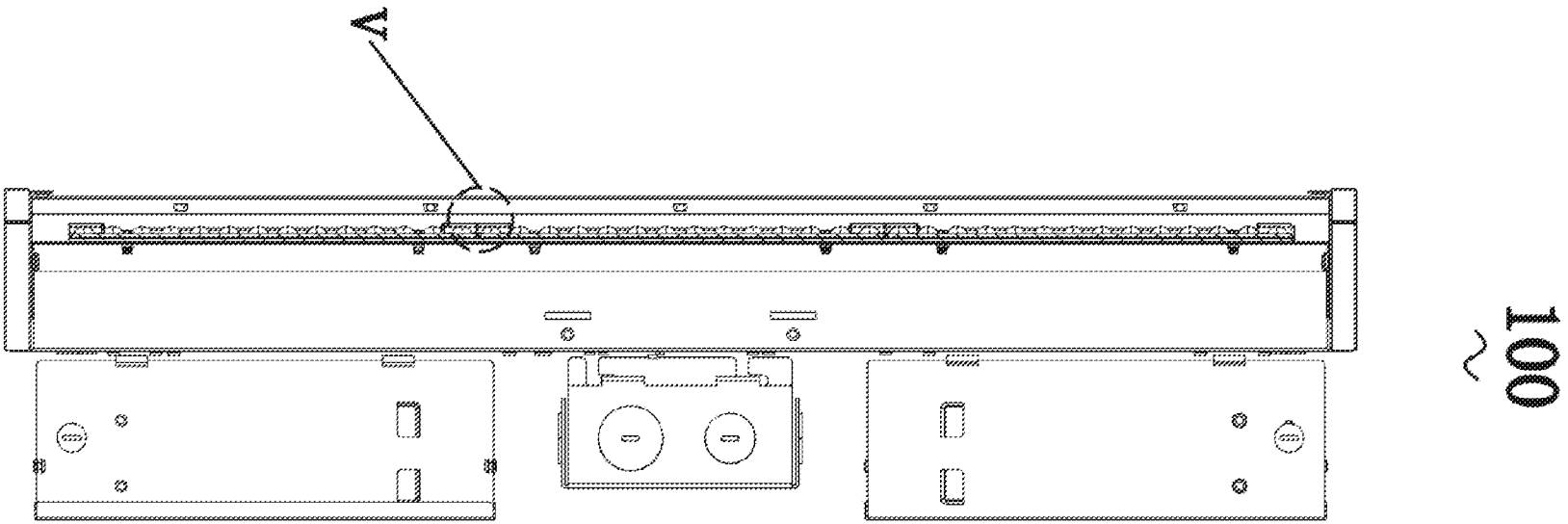
FIG. 3 is a section structure diagram of the LED high bay light along the A-A section line shown in FIG. 2.
Figure 4:
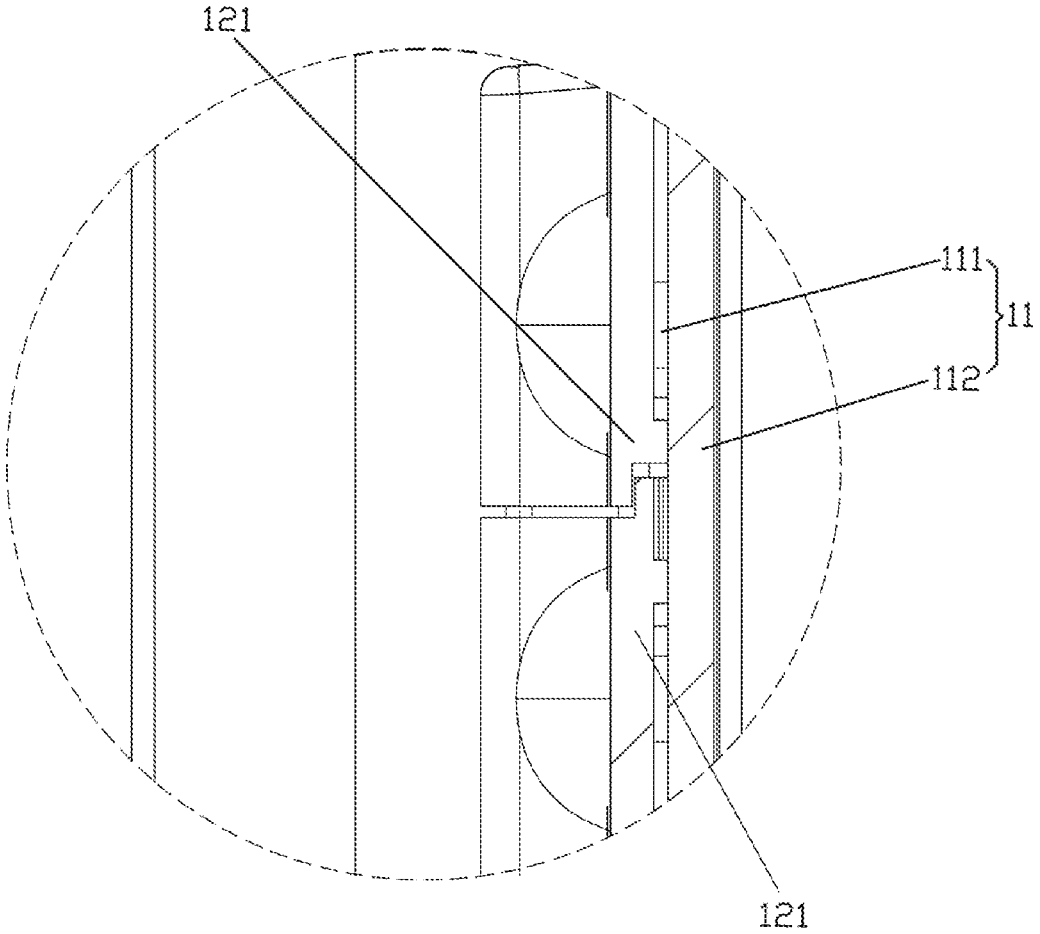
FIG. 4 is a structure diagram of View V-V of the LED high bay light shown in FIG. 3.

In the embodiment, as shown in FIGS. 2-4, the LED strip-shaped illuminant 11 includes a plurality of LED lamp beads 111 and an LED strip-shaped driving circuit board 112 that drives the LED lamp beads 111 to operate; the LED lamp beads 111 are distributed on the surface of the LED strip-shaped driving circuit board 112 in a matrix; the optical lens set 12 is closely fitted to the surface of the LED strip-shaped driving circuit board 112 to cover a plurality of LED lamp beads 111. The optical lens set 12 is connected to the corresponding LED strip-shaped driving circuit board 112 in a fastening manner through a screw structure 13. As shown in FIG. 2, the strip-shaped optical lens 121 is arranged with a convex rib structure 1211 along both sides of the strip-shaped optical lens 121 respectively, and the convex rib structure 1211 is pressed fit and even with the LED strip-shaped driving circuit board 112 after being assembled, and the strip-shaped illuminant 11 is separately partitioned for sealing by the convex rib structure 1211 so that the lighting fixture can reach a dust prevention level of IP5.

In addition, as shown in FIG. 1, the LED high bay light 100 further includes two side plates 2 arranged oppositely and alternately for fixing lamp body; both sides of each of the LED illuminant engines 1 are movably connected to one of the side plates 2 for fixing lamp body through a mutual cooperation between an arc slot (not shown in drawings) and a screw structure (not shown in drawings) respectively, allowing the rotation angle of each of the LED illuminant engines 1 to be slightly adjusted through such structure. The LED high bay light 100 further includes a strip-shaped power box 3; both ends of the strip-shaped power box 3 are connected to one of the side plates 2 for fixing lamp body in a fastening manner; each of the LED illuminant engines 1 is electrically connected to the strip-shaped power box 3 respectively; as a regular power supply device for the LED illuminant engines 1, the strip-shaped power box 3 can be connected to mains supply and provide normal working current to the LED high bay light 100. The LED high bay light 100 further includes two emergency power packs 4; the two emergency power packs 4 are arranged oppositely and alternately on the strip-shaped power box 3, and the two emergency power packs 4 are electrically connected to the strip-shaped power box 2; with a built-in battery of high capacity, the LED high bay light 100 can enable the battery automatically to provide emergency electrical power supply. A convex rod for mounting suspending chain 41 is arranged on two opposite sides of each of the emergency power pack 4 respectively, allowing the LED high bay light 100 to be conventionally mounted with chain. The LED high bay light 100 further comprises a mounting box for suspender 5; the mounting box for suspender 5 is arranged on the strip-shaped power box 3, and between the two emergency power packs 4, allowing the LED high bay light 100 to be quickly mounted with a suspender.

The LED high bay light provided by the embodiment, wherein, the optical lens set of each of the LED illuminant engines formed with a plurality of conterminous strip-shaped optical lens 121 is of a structure of multiple sections; the length of the mold of individual optical lens is shorter than the height of the overall optical lens and the process for manufacturing parts is simpler than that for the overall optical lens, therefore, such structure of multiple sections may not only control the risk in product development, but also greatly reduce the difficulty in making molds and the cost for manufacturing parts. Meanwhile, two adjacent strip-shaped optical lenses 121 are connected to each other through a mutual cooperation of the stepped spigots arranged oppositely, not only preventing position shifting and malposition, improving the reliability of the product and realizing perfect assembly and location of the strip-shaped optical lenses, but also preventing dusts entering the illuminant and causing secondary pollution.

The above are the preferred embodiments rather than the limitations of the Invention. Any amendment, equivalent replacement and improvement made within the range of the spirit and rule of the Invention shall be included in the protection scope of the Invention.

What is claimed is:

1. An LED high bay light, wherein, the LED high bay light comprises a plurality of LED illuminant engines arranged abreast and alternately; each of the LED illuminant engines comprises an LED strip-shaped illuminant and an optical lens set covering the LED strip-shaped illuminant; the optical lens set comprises a plurality of strip-shaped optical lenses arranged conterminously; and two adjacent strip-shaped optical lenses are connected to each other through a mutual cooperation of stepped spigots arranged oppositely;

the LED high bay light further comprises two side plates arranged oppositely and alternately for fixing lamp body; both sides of each of the LED illuminant engines are movably connected to one of the side plates for fixing lamp body through a mutual cooperation between an arc slot and a screw structure respectively;

the LED high bay light further comprises a strip-shaped power box; both sides of the strip-shaped power box are connected to one of the side plates for fixing lamp body respectively in a fastening manner; each of the LED illuminant engines is electrically connected to the strip-shaped power box respectively; and the LED high bay light further comprises two emergency power packs; the two emergency power packs are arranged oppositely and alternately on the strip-shaped power box, and the two emergency power packs are electrically connected to the strip-shaped power box.

2. The LED high bay light according to claim 1, wherein, the LED strip-shaped illuminant comprises a plurality of LED lamp beads and an LED strip-shaped driving circuit board that drives the LED lamp beads to operate; the LED lamp beads are distributed on the surface of the LED strip-shaped driving circuit board in a matrix; the optical lens set is closely fitted to the surface of the LED strip-shaped driving circuit board to cover the LED lamp beads; the optical lens set is connected to the corresponding LED strip-shaped driving circuit board in a fastening manner through a screw structure.

3. The LED high bay light according to claim 1, wherein, a convex rib structure is arranged along both sides of the strip-shaped optical lens respectively.

4. The LED high bay light according to claim 1, wherein, a convex rod for mounting suspending chain is arranged on two opposite sides of each of the emergency power pack respectively.

5. The LED high bay light according to claim 1, wherein, the LED high bay light further comprises a mounting box for suspender; the mounting box for suspender is arranged on the strip-shaped power box, and between the two emergency power packs.

* * * * *